US005527424A

United States Patent [19]

Mullins

[11] Patent Number: 5,527,424

[45] Date of Patent: Jun. 18, 1996

[54] PRECONDITIONER FOR A POLISHING PAD AND METHOD FOR USING THE SAME

[75] Inventor: James M. Mullins, Austin, Tex.

[73] Assignee: Motorola, Inc., Schaumburg, Ill.

[21] Appl. No.: 380,770

[22] Filed: Jan. 30, 1995

[51] Int. Cl.[6] ..... H01L 21/302; B24B 1/00

[52] U.S. Cl. ..... 156/636.1; 156/345; 156/645.1; 216/90; 451/444

[58] Field of Search ..... 216/90, 91; 156/345, 156/636.1, 645.1; 451/56, 72, 443, 444

[56] References Cited

U.S. PATENT DOCUMENTS 5,081,051 1/1992 Mattingly et al. ..... 437/10

5,216,843 6/1993 Breivogel et al. ..... 51/131.1

5,456,627 10/1995 Jackson et al. ..... 451/11

*Primary Examiner*—R. Bruce Breneman

*Assistant Examiner*—Anita Alanko

*Attorney, Agent, or Firm*—Minh-Hien N. Clark

[57] ABSTRACT

A preconditioning plate (10) prepares the surface of a polishing pad (24) to prepare the pad's surface for subsequent metal polishing of semiconductor wafers (27). The preconditioning plate has at least three intersecting radial ridges (14) on its surface and is made from a rigid plastic material. The preconditioning plate is rotated relative to the surface of the polishing pad prior to actual polishing to provide a uniform and stable polishing surface. The preconditioning plate does not abrade or wear away the polishing pad, nor does it form grooves in the polishing pad. Additionally, the preconditioning plate is reusable.

20 Claims, 2 Drawing Sheets

PRECONDITIONER FOR A POLISHING PAD AND METHOD FOR USING THE SAME

FIELD OF THE INVENTION

The present invention relates in general to semiconductor processing and more specifically to the field of a structure for mechanical polishing and a method of using the same to planarize a semiconductor substrate.

BACKGROUND OF THE INVENTION

Current semiconductor processing generally uses an elaborate system of metallization interconnects to couple the various devices which have been fabricated on the semiconductor substrate. Commonly, aluminum or some other metal is deposited and then patterned to form interconnect paths along the surface of the silicon substrate. In most processes, a dielectric or insulated layer is then deposited over this first metal layer. Via openings are etched through the dielectric layer and a second metal layer is then deposited. The second metal layer covers the dielectric layer and fills the vias to make electrical contact with the underlying first metal layer. The purpose of the dielectric layer is to provide an insulator between the metal layers. Thus, if a third metal layer is required, then second dielectric layer must be deposited over the second metal layer to provide electrical insulation.

Often, the different deposited dielectric layers are conformal layers which correspond in height to the underlying metal lines. Thus, the upper surface of each dielectric layer is characterized by a series of nonplanar height variations which has been found to be undesirable. The art provides various methods for planarizing the surface of the dielectric layers. One such method employs abrasive polishing to remove the protruding steps along the surface of the dielectric layer. In this method, the silicon substrate is placed faced down on a table covered with a polishing pad which has been coated with a slurry or abrasive material. Both the substrate and the table are then rotated relative to each other to remove the protrusions on the substrate. This process of planarizing the substrate surface is generally referred to as chemical mechanical polishing (CMP).

One factor in achieving and maintaining a high and stable polishing rate for CMP is pad conditioning which is a technique where the pad surface is prepared into a proper state for subsequent polishing work. Various methods are available to condition the polishing pad. One method cuts circumferential grooves into the polishing pad surface to channel slurry between the substrate surface and the pad. These grooves are formed prior to polishing by means of a milling machine, a lathe, or a press. A problem with this method is that the ridges forming the grooves become worn down after repeated polishing cycles. The smoothed out polishing surface results in a reduction of slurry delivery beneath the substrate surface. This degradation in pad roughness over time results in low, unstable, and unpredictable polish rates.

A related method simply provides a polishing pad with preformed, circumferential, triangular grooves. Then during the polishing step, a diamond tip on an oscillating stylus cuts additional radial grooves into the polishing pad to further channel the slurry between the pad and the substrate surface. This method suffers similar drawbacks as the previous method because the circumferential grooves eventually get worn away, and the radial grooves being cut into the pad during polishing decrease the life of the pad.

A third alternative method uses a diamond conditioning disk to condition the polishing pad prior to polishing of the wafer. This method suffers the drawback of the diamonds eventually being lost from the conditioning disk and becoming mixed in with the slurry. The loose diamond granules in the slurry can scratch the polished surface of the wafer. Also, the diamond conditioning disk must eventually be discarded once the diamonds are lost from the surface. Another disadvantage is that this method also abrades the surface of the polishing pad by removing a layer of the polishing pad surface.

All of these above methods are known methods for polishing of dielectric layers. A different challenge exists when the metal layers need polishing. A metal layer requires polishing, for example, when a layer is deposited for filling vias. Once the vias are filled, then the excess metal is polished away before the next device fabrication processing step. The above methods do not work for metal polishing. One reason is that all of them abrade the polishing pad in a manner inconsistent with the requirements of metal polishing. The pad surface does not yield uniform polished surfaces without continual reconditioning of the polish pad. Moreover, abrading the polishing surface dramatically reduces the useful life of the pad, and it must be changed out often, causing delay in the polishing cycle time as well as adding to the cost of the process. Additionally, the diamond disk method introduces corrosion problems due to the metal on the substrate reacting with the polishing slurry due to the diamonds in the slurry.

One method evaluated for metal polishing involved using a brush to roughen the surface of the polishing pad as the preconditioning step. This method had several drawbacks. First, residue accumulated in the bristles making the brushes hard to clean. Secondly, the bristles on the brushes tended to break off in the process, leading to undesirable matter in the slurry. Furthermore, the brushes wore out quickly even when the bristles did not break, making this solution very impractical.

One method for successfully polishing metal is to use dummy or blanket wafers as a preconditioning step for the polishing pad. This method uses blank silicon wafers having a top surface layer of tungsten in the polishing apparatus to prepare the surface of the polishing pad for subsequent real polishing work. The polishing rate and uniformity of the polished surface are monitored after each blanket wafer until a stable polishing rate is achieved. Only then are real wafers needing to be polished placed on the polishing apparatus to be processed. This method is time consuming because approximately 10 blanket wafers are required before the polishing pad surface is ready for metal polishing. This preconditioning step requires approximately 40–50 minutes to complete and must be repeated whenever a new polishing pad is installed and also whenever the polishing pad has remained idle for a short period of time, approximately 15 minutes. Thus, a method for quickly attaining a saturated and stable surface for polishing to avoid pockets of slurry giving rise to an uneven polished surface is desired.

It is important to point out that the illustrations may not necessarily be drawn to scale, and that there may be other embodiments of the present invention which are not specifically illustrated.

DETAILED DESCRIPTION OF A PREFERRED EMBODIMENT

The present invention provides, in one embodiment, a preconditioning plate for a polishing pad to prepare the pad's surface for subsequent polishing of semiconductor wafers. The invention is well suited for use in metal polishing because the material of the preconditioning plate does not react with the slurry to cause corrosion problems on the wafer. The preconditioning plate has at least three intersecting radial ridges on its surface and is made from a rigid plastic material. The preconditioning plate is rotated relative to the surface of the polishing pad prior to actual polishing to provide a uniform and stable polishing surface. The preconditioning plate does not abrade or wear away the polishing pad, nor does it form grooves in the polishing pad. Additionally, the preconditioning plate is reusable. Use of the preconditioning plate reduces the pad conditioning time by approximately 90% which substantially reduces cycle time. These and other features, and advantages, will be more clearly understood from the following detailed description taken in conjunction with the accompanying drawings.

Figure 1:
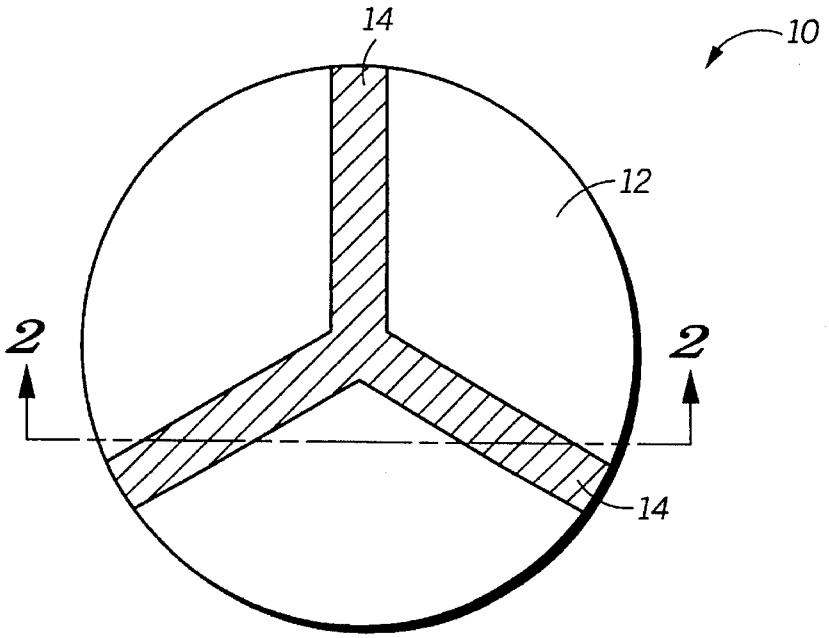
FIG. 1 illustrates, in a top view, a preconditioning plate in a first embodiment of the present invention.

In FIG. 1, a top view of a preconditioning plate 10 is illustrated as a first embodiment of the invention. Preconditioning plate 10 is shown to be a round disk 12 having three intersecting radial ridges 14 on its top surface. One reason why radial ridges are used, as opposed to circumferential ridges, is to distribute the slurry evenly across the surface of the polishing pad (not illustrated in this figure) during the preconditioning step. As even distribution is desired, it preferred that the intersecting radial ridges 14 divide the surface of the disk 12 into approximately equal sectors. It is envisioned that at least three ridges are required to effectively condition the polishing pad for subsequent polishing work. However, the preconditioning plate 10 is in no way limited to having only three intersecting ridges as a greater number of ridges may also be used. An actual reduction to practice, which will be discussed in more detail below, used more than three radial intersecting ridges. A cross-section taken along line 2—2 illustrates the shape of the ridges 14 in more detail.

Figure 2:
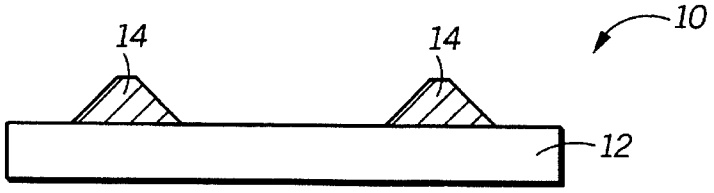
FIG. 2 illustrates, in a cross-section along line 2—2, the preconditioning plate of FIG. 1.

As shown in FIG. 2, the ridges 14 have "triangular" shapes. Each ridge is flattened out at the top to eliminate sharp edges to prevent abrasion of the polishing pad surface (not shown) during the preconditioning step. Additionally, the ridge top is flattened in order to lessen the chance of a portion of the ridge breaking or chipping during the preconditioning step. It is not critical to remove exactly a certain amount of material at the top of the ridge. What is important is that the top is sufficiently flattened to remove the sharp edge but not so much that the tip is too blunt which would reduce the efficacy of the preconditioning plate in preparing the polishing pad surface. As seen in FIG. 2, the triangular ridges 14 are formed by intersecting sloping planes. These planes or sidewalls of the ridges have slope angles approximately in a range of 30° to 60° . The ridges have a recommended height ranging from 1.5 to 5 mm when the plate 12 thickness ranges from 3 to 12 mm. The plate thickness is actually a function of the stiffness of the material used because it is necessary to keep the plate flat and rigid during the machining process. From a practical standpoint, a low height ridge will work better on a thinner plate, while a higher ridge may work better in combination with a thicker plate.

The preconditioning plate 10 should be made from a chemically neutral and inert material to prevent any reaction with the slurry. The slurry used in polishing is very corrosive, having a pH of 1–2, so the material should be able to withstand those type of conditions. Additionally, the material should be machinable, durable, and rigid to form a sufficiently stiff plate for handling and for the preconditioning step where the ridges on the plate are to roughen the surface of the polishing pad for subsequent polishing work. Materials that are suitable for the preconditioning plate include polyvinylidine fluoride (PVDF) and polymethyl methacrylate (PMMA). Other plastic materials, such as polyvinyl chlorides and polycarbonates may also be suitable. Additionally, while there is no requirement that the ridges on the preconditioning plate be of the same material as the bulk of the plate itself, it is probably most preferable to have the entire preconditioning disk be made of the same material. In that case, the ridges could be machined, laser etched or otherwise formed from a bulk disk to form the preconditioning plate 10.

Figure 3:
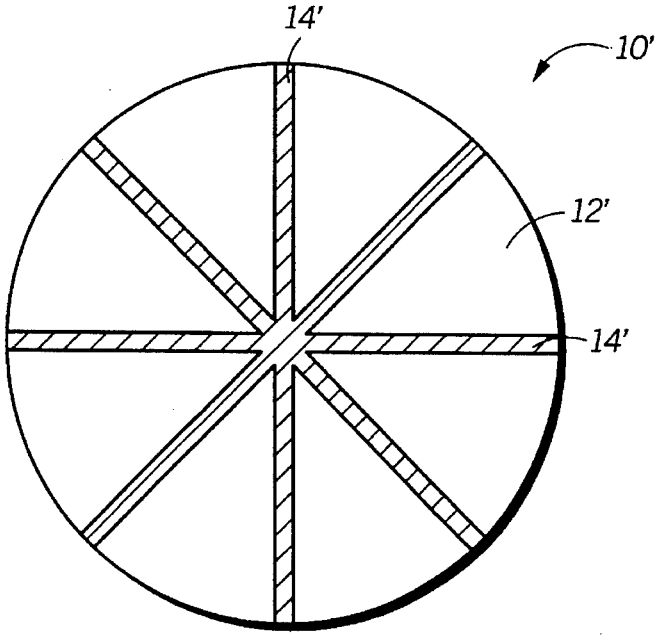
FIG. 3 illustrates, in a top view, an alternative embodiment of the present invention.

FIG. 3 illustrates another embodiment of the preconditioning plate of the present invention. As mentioned above, the number of ridges is not limited to three intersecting radial ridges but can be a larger number. In an actual reduction to practice, a preconditioning plate 10' having eight intersecting radial ridges 14', dividing the disk into eight sectors, was made from PVDF. The symmetrical pattern formed by an even number of ridges should not be considered in any way limiting, because an odd number of ridges may also be used. In the reduction to practice, the plate was 9 inches (229 mm) in diameter and 0.125 inches (3.18 mm) thick. The ridges were also approximately 3.18 mm thick. It is desirable to have sufficiently high ridges to channel the slurry evenly across the surface of the pad. Additionally, a uniformly flat surface in between ridges will prevent the slurry from being trapped in pockets on the disk surface. The ridges were formed having sidewall angles of 45° , and the tops of the ridges were chamfered to remove a sharp edge to prevent forming grooves in the polishing pad and to prevent breakage/chipping of the ridge tops. It is important to note that the preconditioning plate 10' made from PVDF did not form or cut any type of grooves in the polishing pad itself. The ridges on the plate merely served to condition the polishing pad surface to achieve a uniform and stable polishing rate.

Figure 4:
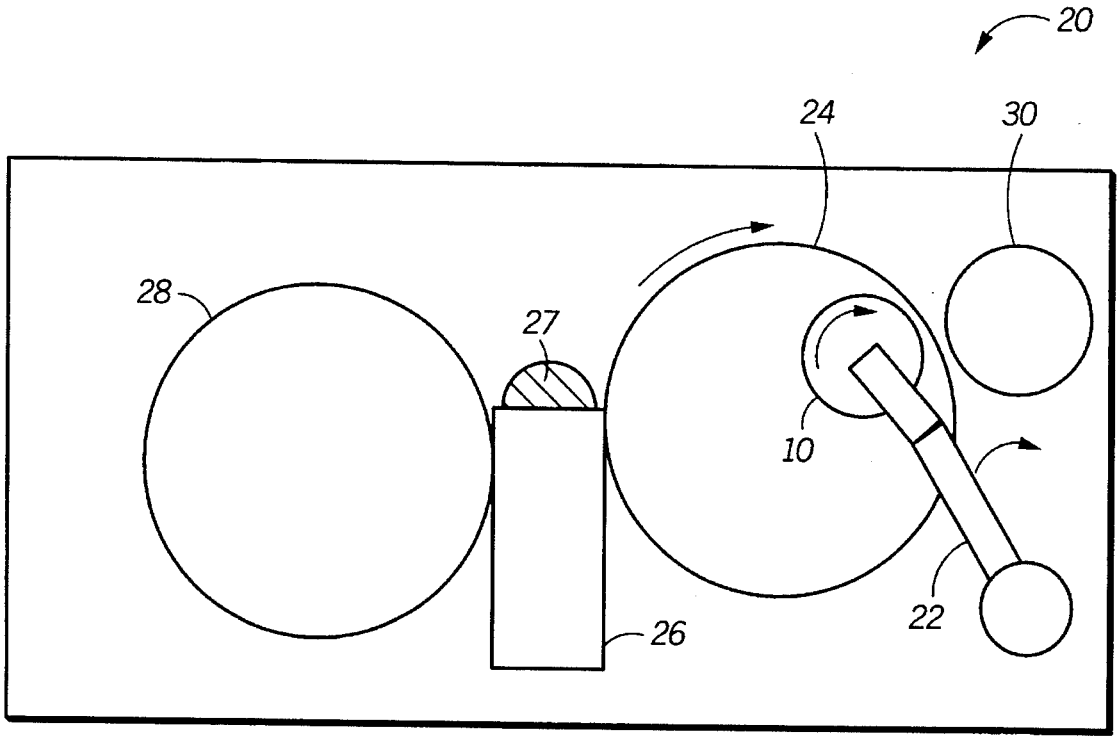
FIG. 4 illustrates, in a top view, a schematic of a polishing apparatus to illustrate a method of use for a preconditioning plate of the invention.

FIG. 4 illustrates, in a top view, a schematic of a polishing apparatus 20 to illustrate a method of use for the preconditioning plate 10 of the invention. The preconditioning plate 10 fits onto the face of the end effector drive apparatus 22. This drive apparatus 22 positions the preconditioning plate 10 over a portion of the surface of the primary polishing pad 24, which is the polishing pad requiring preconditioning. In practice, the preconditioning step is described as harmonic conditioning, wherein the same point on the polishing pad 24 passes the same point on the preconditioning plate 10 with reoccurring predictability, which is the reason why it is desirable to have the preconditioning plate 10 be smaller than the polishing pad 24. In a method of use for the preconditioning plate 10, the plate 10 is rotated relative to the polishing pad 24 for approximately five minutes prior to polishing of a wafer. The speed of the rotation is controllable on the equipment. An actual speed on a reduction to practice was 28 rpm for five minutes. The rotational speed of the preconditioning step is in no way limited because it can be easily varied. After this simple and quick preconditioning step, the polishing pad 24 is primed and ready for the polishing of actual semiconductor wafers. One polishing pad may be used for a large number of wafers if no abrasion of the pad occurs. Because the present method does not abrade the polishing pad, approximately 200 wafers can be polished per single polishing pad. With each new polishing pad, a five-minute preconditioning run is required.

After the five minute preconditioning step, then the polish arm 26 which carries the semiconductor substrate 27 to be polished is positioned over the conditioned polishing pad 24. The semiconductor substrate 27 is then rotated relative to the polishing pad for a specified amount of time, typically 3–5 minutes for a tungsten layer, until the excess metal from surface of the substrate is removed. After the first polishing step, it is typical for the substrate 27 to be given a final polish on the final polish pad 28. This final polish pad 28 has not been found to require preconditioning in current processing techniques. Once the primary polishing pad 24 is preconditioned initially, prior to any actual polishing work, it need not be reconditioned between polishing of semiconductor wafers. However, it may be desirable to condition the polishing pad periodically, such as once every shift, during the manufacturing process to monitor the process and to ensure that the polishing removal rate is remaining stable. This method still presents a substantially reduced cycle time process over the present practice in the art.

Figure 5:
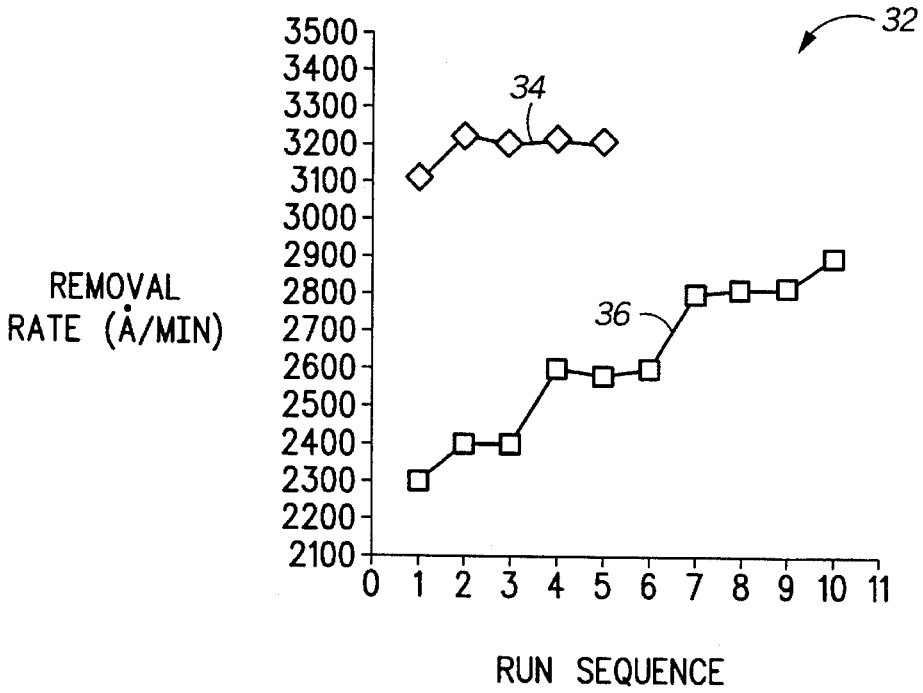
FIG. 5 is a graph comparing the removal rate achieved with a preconditioning plate of the invention and a prior art method.

A major advantage to the present invention is the reduction in preconditioning cycle time. FIG. 5 is a graph 32 comparing the removal rate 34 achieved with a preconditioning plate of the invention and the removal rate 36 with a prior art method wherein blanket wafers are used to condition the polishing pad. The removal rate of the polishing pad is a measure of the readiness of the pad for polishing work: a uniform rate is required before actual polishing of wafers are performed. As can be seen, the removal rate 34 is achieved with the use of the present invention. The first run sequence uses the preconditioning plate to prepare the polishing pad. All subsequent run sequences show that the removal rate is uniform and stable so that in practice, from the second run sequence until the polishing pad is replaced, actual wafers may be polished. Contrast to the removal rate 36 which is a measure of the prior art method where blanket or dummy wafers are used to condition the pad. Approximately ten blanket wafers must be used before a stable polishing rate is achieved. Thus, by using the present invention, approximately 40–45 minutes can be saved for every polishing pad used.

The foregoing description and illustrations contained herein demonstrate many of the advantages associated with the present invention. In particular, it has been revealed that the present invention has many advantages over the prior art. It is simple yet very effective. Corrosion is eliminated because the plastic material used for the plate does not react with metal slurry or any of the materials on the semiconductor wafer. Actual reduction to practice has shown that no wearing or staining of the preconditioning plate occurs because the plastic material is non-reactive and stable. Furthermore, since there is no diamond particles being used, no diamonds can break lose and react with the slurry or leave a residue on the surface of the polishing pad or the preconditioning plate. Additionally, residue buildup from blanket wafers is eliminated since no blanket wafers are required to achieve a uniform surface for polishing. Another major advantage to the present invention is that it is extremely cost effective. The preconditioning plate is easily made in a machine shop using inexpensive materials and a single plate is reusable for long periods of polishing. The same plate can be cleaned after each preconditioning cycle and then reused for the next new polishing pad.

Thus it is apparent that there has been provided, in accordance with the invention, a preconditioning plate for a polishing pad and a method for using the plate that fully meet the need and advantages set forth previously. Although the invention has been described and illustrated with reference to specific embodiments thereof, it is not intended that the invention be limited to these illustrative embodiments. Those skilled in the art will recognize that modifications and variations can be made without departing from the spirit of the invention. For example, the plate may be non-circular in shape. Furthermore, the number and size of the ridges on the preconditioning plate as well as the size of the plate itself may be varied from those discussed. Additionally, the type of slurry may be changed to modify the desired removal rate achievable with the use of the present invention. Also, the rotational speed of the preconditioning step may be varied. Therefore, it is intended that this invention encompasses all such variations and modifications falling within the scope of the appended claims.

I claim:

1. A preconditioner for a mechanical polishing pad on a polishing system comprising:

a plate having at least three intersecting ridges on a surface of the plate, wherein the at least three intersecting ridges extend radially outward from a center of the plate, the plate being composed of a rigid and chemically neutral polymer.

2. The preconditioner of claim 1, wherein the plate is composed of a material selected from a group consisting of polyvinylidine fluoride and polymethyl methacrylate.

3. The preconditioner of claim 1, wherein the plate has a thickness approximately in a range of 3 to 12 millimeters.

4. The preconditioner of claim 1, wherein the ridges are triangular shaped and each has a chamfered ridge top such that it is flattened to prevent breakage by eliminating sharp edges.

5. The preconditioner of claim 1, wherein the ridges have a height approximately in a range of 1.5 to 5 millimeters.

6. The preconditioner of claim 1, wherein the ridges are formed by intersecting planes having a slope angle approximately in a range of 30° to 60°.

7. A method for polishing a semiconductor wafer, comprising the steps of:

providing a preconditioner having at least three intersecting ridges on a face of the preconditioner, wherein the at least three intersecting ridges extend radially outward from a center of the preconditioner, the preconditioner being composed of a rigid and chemically neutral polymer;

aligning the preconditioner, face down, over a polishing pad;

rotating the preconditioner, relative to the polishing pad, over a surface of the polishing pad to form a preconditioned polishing pad;

positioning a semiconductor wafer having a metal layer on its face, face down, overlying the preconditioned polishing pad; and rotating the semiconductor wafer, relative to the preconditioned polishing pad to planarize the face of the semiconductor wafer.

8. The method of claim 7, wherein the step of providing the preconditioner is performed by providing a preconditioning disk composed of polyvinylidine fluoride.

9. The method of claim 7, wherein the step of providing the preconditioner is performed by providing a preconditioning disk composed of polymethyl methacrylate.

10. The method of claim 7, wherein the step of rotating the preconditioner is performed for approximately five minutes.

11. The method of claim 7, wherein the step of positioning the semiconductor wafer comprises positioning a wafer having a tungsten layer on its face.

12. The method of claim 7, wherein the step of providing the preconditioner is performed by providing a plastic disk having ridges which are triangular shaped, wherein each ridge has a chamfered ridge top such that it is flattened to prevent breakage by eliminating sharp edges.

13. The method of claim 7, wherein step of providing the preconditioner is performed by providing a plastic disk having triangular ridges having sidewall slope angles approximately in a range of 30° to 60°.

14. A method for polishing a semiconductor wafer, comprising the steps of:

providing a preconditioner having at least three intersecting radial ridges on a face of the preconditioner, wherein the at least three intersecting radial ridges symmetrically divide the face of the preconditioner into a plurality of sectors, the preconditioner being composed of a rigid and chemically neutral polymer;

aligning the preconditioner, face down, over a polishing pad;

rotating the preconditioner, relative to the polishing pad, over a surface of the polishing pad to form a preconditioned polishing pad;

positioning a semiconductor wafer having a metal layer on its face, face down, overlying the preconditioned polishing pad; and rotating the semiconductor ,safer, relative to the preconditioned polishing pad to planarize the face of the semiconductor wafer.

15. The method of claim 14, wherein the step of providing the preconditioner is performed by providing a preconditioning disk composed of polymethyl methacrylate.

16. The method of claim 14, wherein the step of providing the preconditioner is performed by providing a preconditioning disk composed of polyvinylidine fluoride.

17. The method of claim 16, wherein the step of rotating the preconditioner is performed for approximately five minutes.

18. The method of claim 16, wherein the step of providing the preconditioning disk provides said disk having triangular ridges, wherein each triangular ridge has a chamfered ridge top such that it is flattened to eliminate sharp edges.

19. The method of claim 18, wherein step of providing the preconditioning disk having triangular ridges provides said disk having ridge sidewalls which are sloped at approximately 30° to 60°.

20. The method of claim 19, wherein the step of providing the preconditioning disk provides said disk having a thickness approximately 3 to 12 millimeters and wherein said ridges on the face of the disk have a height measuring approximately 1.5 to 5 millimeters.

* * * * *